US006125783A

United States Patent [19]

Shimmell, Sr. et al.

[11] Patent Number: 6,125,783

[45] Date of Patent: Oct. 3, 2000

[54] MARINE VESSEL FLUSH MOUNT SYSTEM

[76] Inventors: Dennis S. Shimmell, Sr., 3383 Harrison St., Hudsonville, Mich. 49426; Dennis S. Shimmell, Jr., 1411 Gentian Dr. SE., Kentwood, Mich. 49508

[21] Appl. No.: 09/300,587

[22] Filed: Apr. 27, 1999

[51] Int. Cl.[7] ..... B63B 8/00

[52] U.S. Cl. ..... 114/343; 114/364

[58] Field of Search ..... 114/343, 364, 114/218, 123, 65 R; 411/427

[56] References Cited

U.S. PATENT DOCUMENTS 4,041,716 8/1977 Thompson ..... 61/48

5,676,088 10/1997 Blaisdell et al. ..... 114/357

*Primary Examiner*—Ed Swinehart

*Attorney, Agent, or Firm*—Warner Norcross & Judd

[57] ABSTRACT

A flush mount system for a marine vessel including a backing plate with at least one adjustable height stud. The backing plate is secured to the inner surface of the mounting structure. The stud is threaded to the backing plate and extends through the mounting structure. The stud defines a threaded bore that is adapted to receive a mounting bolt for the desired accessory. The stud is threaded within a through-bore in the backing plate to permit the height of the stud to be easily adjusted. A locknut is threaded over the stud against the backing place to lock the stud in place at the desired height.

27 Claims, 6 Drawing Sheets

MARINE VESSEL FLUSH MOUNT SYSTEM

BACKGROUND OF THE INVENTION

The present invention relates to marine accessories, and more particular to a mounting system for marine vessels.

A wide variety of accessories, such as davits, ladders, support racks, stand offs, cooking grills, tables, chairs, seats, bike-racks, down riggers, outriggers, trolling motors, fighting chairs (used for fishing), antennae, and the like, are available for boats and other marine vessels. In order to secure these accessories, they are generally mounted directly to the vessel, such as on a portion of the hull, deck, swim platform, radar arch, floor of the flybridge or on interior surfaces (e.g. walls, floors, and ceilings inside a cabin). In many situations, it is desirable to alternate between various accessories, or simply to install and remove a single accessory as needed. This is particularly true of smaller boats and vessels, where space is limited.

Conventionally, accessories are mounted to the vessel using fasteners, such as screws or bolts, that extend into or through the mounting structure. Although hull and deck constructions vary from vessel to vessel, a hull or deck is often manufactured from a layer of decking material, such as marine plywood, that is covered typically on both sides by fiberglass resin and fiberglass cloth. Often, a smooth or non-skid gelcoat is applied over the fiberglass layer. In some locations, the decking material may be eliminated and the deck or wall may include only fiberglass and gelcoat layers.

When screws are used to install accessories, they preferably extend into the decking material. In locations where there is no decking material or when the accessories are relatively light-weight, the screws may extend only into the fiberglass layer. When bolts are used to install the accessories, they typically extend through the hull or deck and are tightened against the undersurface or back surface by conventional nuts. Because of the structural characteristics of a conventional hull or deck, washers or a backing plate are typically used to distribute forces exerted by the mounting bolts and reduce the likelihood of damage to the hull or deck.

These conventional mounting techniques suffer in several respects. Screws typically will not provide the strength and support needed to install larger accessories or small accessories that are subject to larger forces. Screws have a tendency to pull free from the deck or hull under force. Although bolts provide greater strength and support, they do not permit easy installation and removal of accessories. For example, repeated installation and removal of accessories using bolts requires repeated access to the undersurface or back surface of the mounting location so that the nuts as well as any desired backing plates or washers can be installed and removed. Further, when an accessory is removed, both screws and bolts leave open holes extending through the hull or deck. These holes reduce the structural integrity of the hull, are unsightly and may permit water to leak into the hull where it can cause significant damage.

In addition, the thickness of the hull or deck often varies from vessel to vessel and from location to location throughout the same vessel, primarily to accommodate different structural requirements. Also, smaller variations in the thickness of the hull or deck result from variations in the thickness of the fiberglass layer, which are inherent due to the methods in which fiberglass is laid. These variations in the thickness of the mounting structure can further complicate efforts to mount accessories.

SUMMARY OF THE INVENTION

The aforementioned problems are overcome by the present invention wherein a flush mount system is provided for mounting accessories to a marine vessel. The flush mount system includes a backing plate and at least one stud that extends from the backing plate through the deck or hull. The backing plate is secured to the undersurface or back surface of the hull or deck. Each stud extends through the deck or hull and defines a threaded bore that is adapted to receive mounting bolts for the desired accessory.

In a preferred embodiment, the studs are adjustable to accommodate variations in the thickness of the hull or deck. Preferably, the studs are threaded within throughbores in the backing plate. This permits the height of the studs to be easily adjusted simply by threading the stud further into or out of the backing plate. A locking nut is threaded over the stud against the backing place to lock the stud in place at the desired length. This capability is particularly beneficial because, as noted above, hull thickness varies from vessel to vessel and even from location to location within the same vessel.

In another preferred embodiment, the flush mount system includes a cover screw that can be threaded into the stud mounting bore to close the bore when no accessories are installed. The cover screw closes the bore to prevent water from accumulating in the bore or leaking through the bore into the hull.

In yet another preferred embodiment, the flush mount system includes a standard mounting plate that corresponds with the backing plate stud configuration. The standard mounting plate permits accessories that do not have the same mounting configuration as the backing plate to be installed on the flush mount system. The accessories are mounted to the standard mounting plate using conventional fasteners, and the standard mounting plate is in turn mounted to the flush mount system. The standard mounting plate preferably includes a non-scratch, non-marring material on its undersurface that protects against scratches in the surface of the vessel.

The present invention provides a simple and effective flush mount systems. The flush mount system permits a variety of accessories to be quickly and easily installed and removed from the hull or deck of a marine vessel. The mounting studs are flush with the outer surface of the hull or deck so that they do not become obstructions when no accessories are installed. Further, the height of the mounting studs is easily adjusted to account for variations in the thickness of the hull or deck. Also, the cover screw can be installed in the stud bore when no accessories are installed to prevent water from accumulating in the bore or leaking into the hull.

These and other objects, advantages, and features of the invention will be readily understood and appreciated by reference to the detailed description of the preferred embodiment and the drawings.

DETAILED DESCRIPTION OF THE PREFERRED EMBODIMENT

Figure 1:
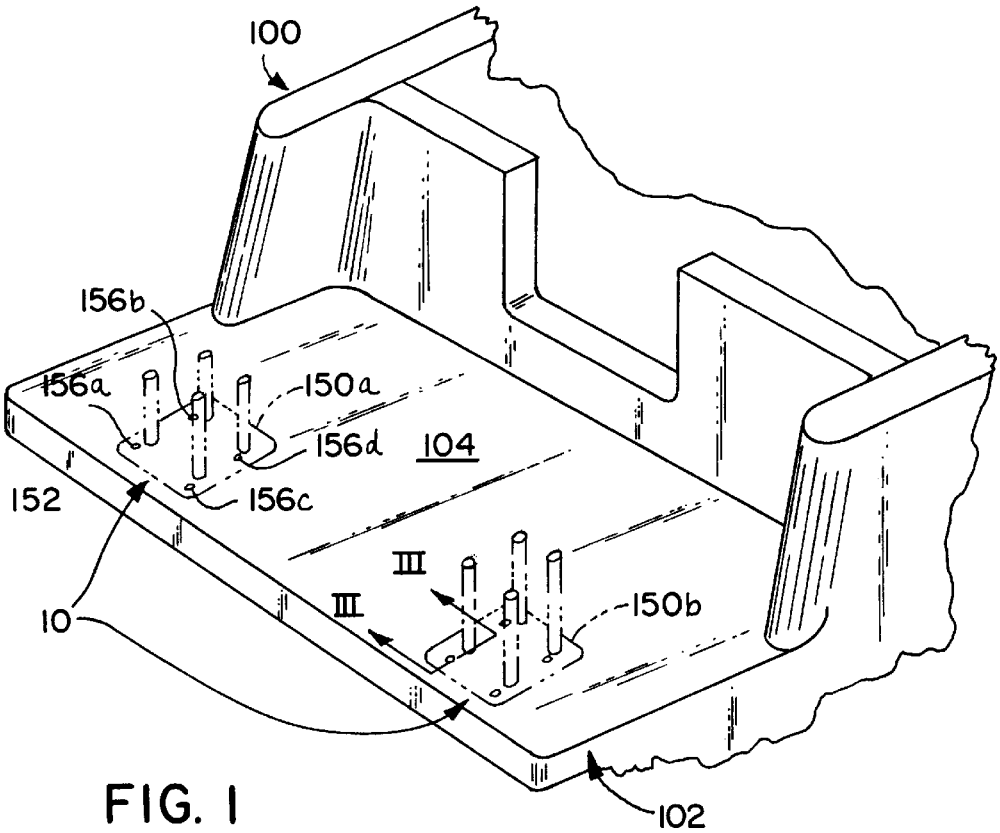
FIG. 1 is a perspective view of a portion of a swim platform of a vessel with a flush mount system in accordance with a preferred embodiment of the present invention, showing the bottom portions of a pair of davits in phantom lines.

A flush mount system in accordance with a preferred embodiment of the present invention is illustrated in FIG. 1, which shows the flush mount system 10 installed in the swim platform 102 of a marine vessel 100 and supporting a pair of conventional davits 150 (in phantom lines). The flush mount system 10 provides a mounting hole arrangement designed to receive mounting bolts for securing an accessory to the swim platform 102. Typically, the mounting bolts extend through the desired accessory's standard mounting plate into the corresponding mounting holes provided by the flush mount system. For purposes of disclosure, and not by way of limitation, the flush mount system 10 is described in connection with a swim platform mounting that permits installation of a variety of accessories on the swim platform 102. The mount system is well suited for use in installing a wide variety of accessories, such as davits, ladders, support racks, stand offs, cooking grills, tables, chairs, seats, bike-racks, down riggers, outriggers, trolling motors, fighting chairs and antennae (collectively referred to herein as "accessories"), in a wide variety of locations in the vessel, such as on a portion of the hull, deck, swim platform, radar arch, floor of the flybridge or on the walls, floors or ceilings inside the cabin or cockpit (collectively referred to herein as "mounting structure"). The term "outer surface" will be used herein to denote the surface of the mounting structure against which the accessory is mounted. The term "inner surface" will be used to denote the surface of the mounting structure opposite the outer surface, such the undersurface or back surface of the deck, hull or other section of the vessel.

Figure 3:
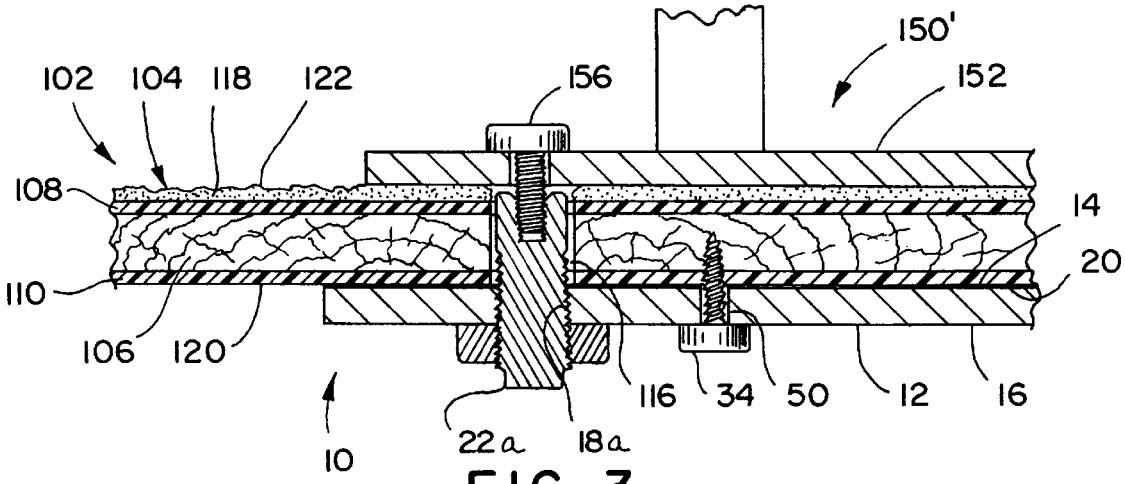
FIG. 3 is a sectional view taken along line III—III of FIG. 1 showing an accessory installed on the flush mount system.
Figure 2:
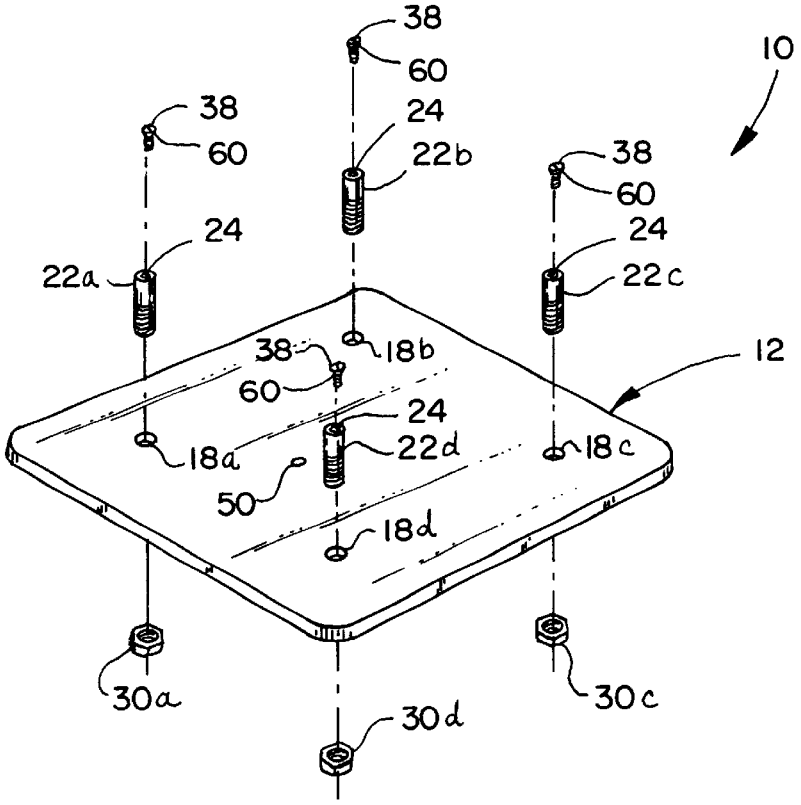
FIG. 2 is an exploded perspective view of the flush mount system.

The flush mount system 10 generally includes a backing plate 12 mounted to the inner surface 120 of the deck 104, a plurality of studs 22*a–d* extending from the backing plate 12 through the deck 104 to its outer surface 122, and a plurality of locknuts 30*d* fitted over the studs 22*a–d* to lock the studs 22*a–d* in place with respect to the backing plate 12 (See FIGS. 1-3). The studs 22*a–d* are accessible from the outer surface 122 and each defines a mounting bore 24 adapted to receive a mounting bolt 156*a–d*. The davit 150 is mounted by installing mounting bolts 156*a–d* through the davit mounting plate 152 into the mounting bores 24.

The vessel 100 includes a substantially planar swim platform 102 that is located at the stem of the vessel 100. The swim platform 102 provides an ideal surface for mounting conventional davits 150*a–b* and other accessories. Referring now to FIG. 3, the swim platform 102 includes a deck 104 having a layer of decking material 106, such as marine grade plywood, that is sandwiched between a top 108 and bottom 110 layers of fiberglass resin and fiberglass cloth. A layer of gelcoat 118 extends over the top fiberglass layer 108. As described in more detail below, a plurality of throughbores 116 are drilled through the swim platform 102 to permit installation of the flush mount system 10. The throughbores 116 include an internal diameter that is slightly greater than the external diameter of the studs 22*a–d*. The throughbores 116 are arranged to correspond with the mounting configuration of the desired accessories. The described deck construction is merely exemplary. The constructions of the deck, hull or other mounting structure will vary from vessel to vessel, and even from location to location within the same vessel.

As noted above, the backing plate 12 is mounted to the inner surface 120 of the deck 104. The backing plate 12 includes an inner surface 14 facing the deck 104 and an outer surface 16 facing away from the deck 104. The backing plate 12 defines a plurality of throughbores 18*a–d* that are internally threaded to receive studs 22*a–d*. The location arrangement, size and thread characteristics of the throughbores 18*a–d* may vary from application to application to correspond with the studs 22*a–d* and the mounting configuration of the desired accessories. In the described embodiment, the throughbores 18*a–d* are arranged in a square pattern with a center to center spacing of eight inches. The backing plate 12 also defines a screw hole 50. As perhaps best shown in FIG. 3, the screw hole 50 receives a mounting screw 34 for securing the backing plate 12 to the deck 104. The preferred embodiment includes a single screw hole 50 and a single mounting screw 34, but additional screws and holes can be added as desired to increase the strength of the attachment. In some applications, the mounting screw 34 can be eliminated and the backing plate 12 can be attached to the deck 104 by other means, such as by adhesives. In the preferred embodiment, the backing plate 12 is secured to the deck 104 by both mounting screw 34 and marine-grade adhesive 20. A variety of suitable adhesives are well-known and readily available from numerous suppliers. The backing plate 12 is preferably manufactured from three-eighths inch series 300 stainless steel. The backing plate 12 can alternatively be manufactured from aluminum, brass or other marine grade materials, with the thickness varying to accommodate the properties of the selected material.

The flush mount system 10 includes a plurality of studs 22*a–d* that are threaded into the throughbores 18*a–d* in the backing plate 12. Each stud 22*a–d* includes external threads 26 adapted to operatively interact with the internal threads of the throughbores 18*a–d*. The diameter and external thread characteristics of the studs 22*a–d* are selected to correspond with the inner diameter and thread characteristics of the throughbores 18*a–d*. Preferably, the external threads 26 extend over only a lower portion 52 of each stud 22*a–d* (e.g. that portion of the stud 22*a–d* that might interact with the locknut 30 and the threads of the backing plate 12). The upper portion 54 of each stud 22*a–d*, for example, the top ¼ inch, is preferably unthreaded to facilitate sealing of the stud 22*a–d* within the throughbore 18*a–d*.

Figure 4:
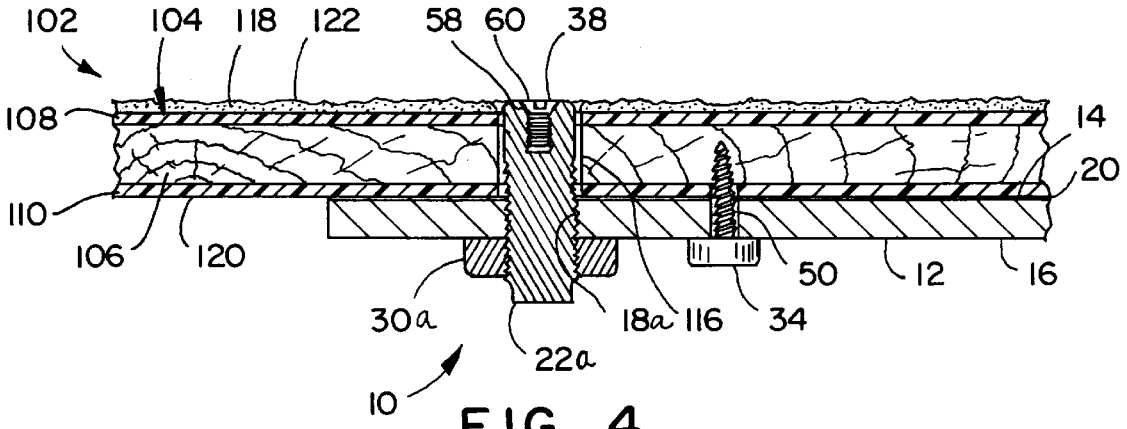
FIG. 4 is a sectional view similar to FIG. 3 showing the cover screw installed in the flush mount system.
Figure 6:
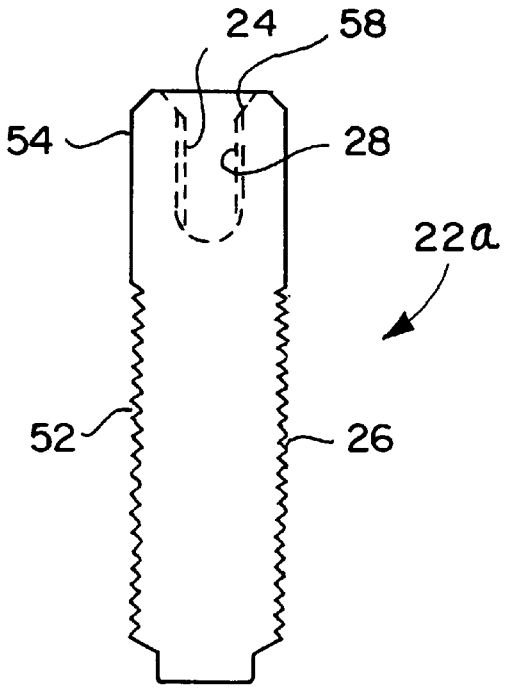
FIG. 6 is a side elevational view of stud.

As perhaps best shown in FIG. 6, each stud 22*a–d* defines a concentric mounting bore 24. The mounting bore 24 preferably extends only partially through the stud 22*a–d* to prevent water from leaking therethrough. The mounting bore 24 includes internal threads 28 adapted to receive the mounting bolts 156. The internal threads 28 preferably extend only partially through the bore 24 and do not overlap with the external threads 26. When the threads overlap, the strength of the stud is reduced in the area of overlap. In applications where a relatively short stud is required, it may be necessary for the external and internal threads to overlap to some degree. In such applications, the diameter of the stud can be increased to compensate for any loss of strength resulting from the overlapping threads. The upper end of the mounting bore 24 preferably includes a countersink 58. The countersink 58 is adapted to receive the head 60 of the cover screw 38 such that the installed cover screw 38 is flush with the deck 104 (See FIG. 4).

Figure 5:
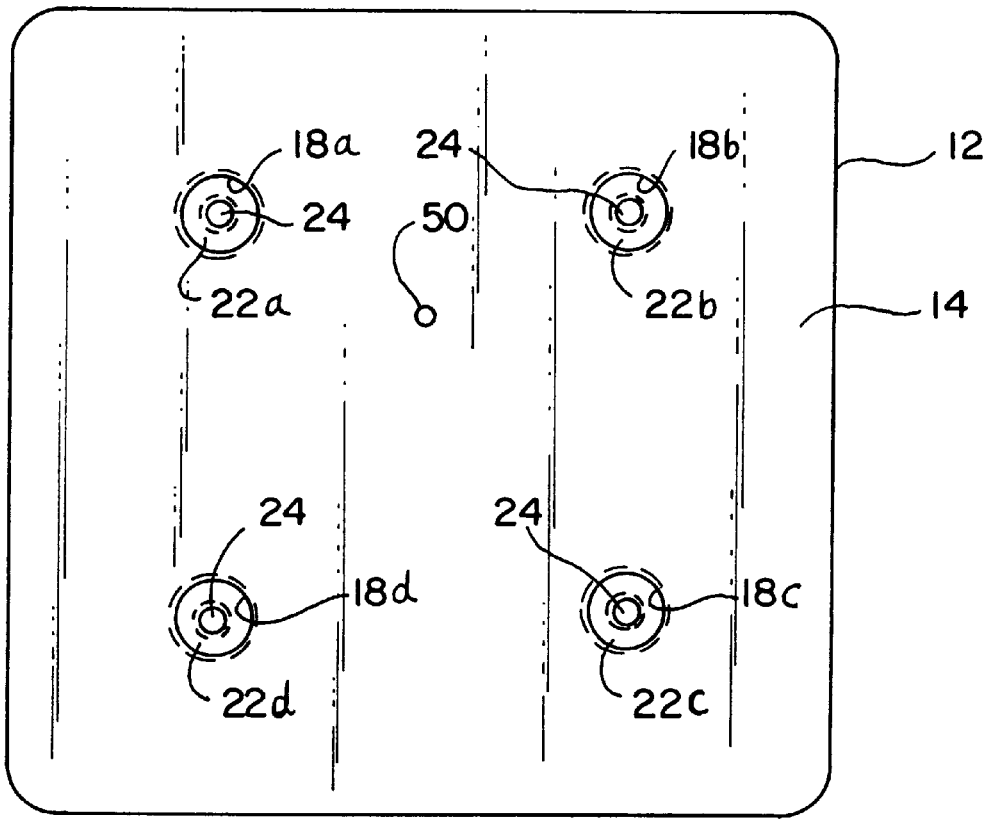
FIG. 5 is a top plan view of a backing plate.

As shown in FIG. 5, the flush mount system 10 is described with four mounting studs arranged in a square configuration. The number and arrangement of mounting studs can vary from application to application depending on the desired mounting footprint. In some applications, only a single stud may be installed in the backing plate. Similarly, the specifications of the stud (e.g. length, diameter, and threads) as well as the specifications of the mounting bore (e.g. diameter, depth, and threads) can vary from application to application to accommodate the desired accessories.

Figure 11:
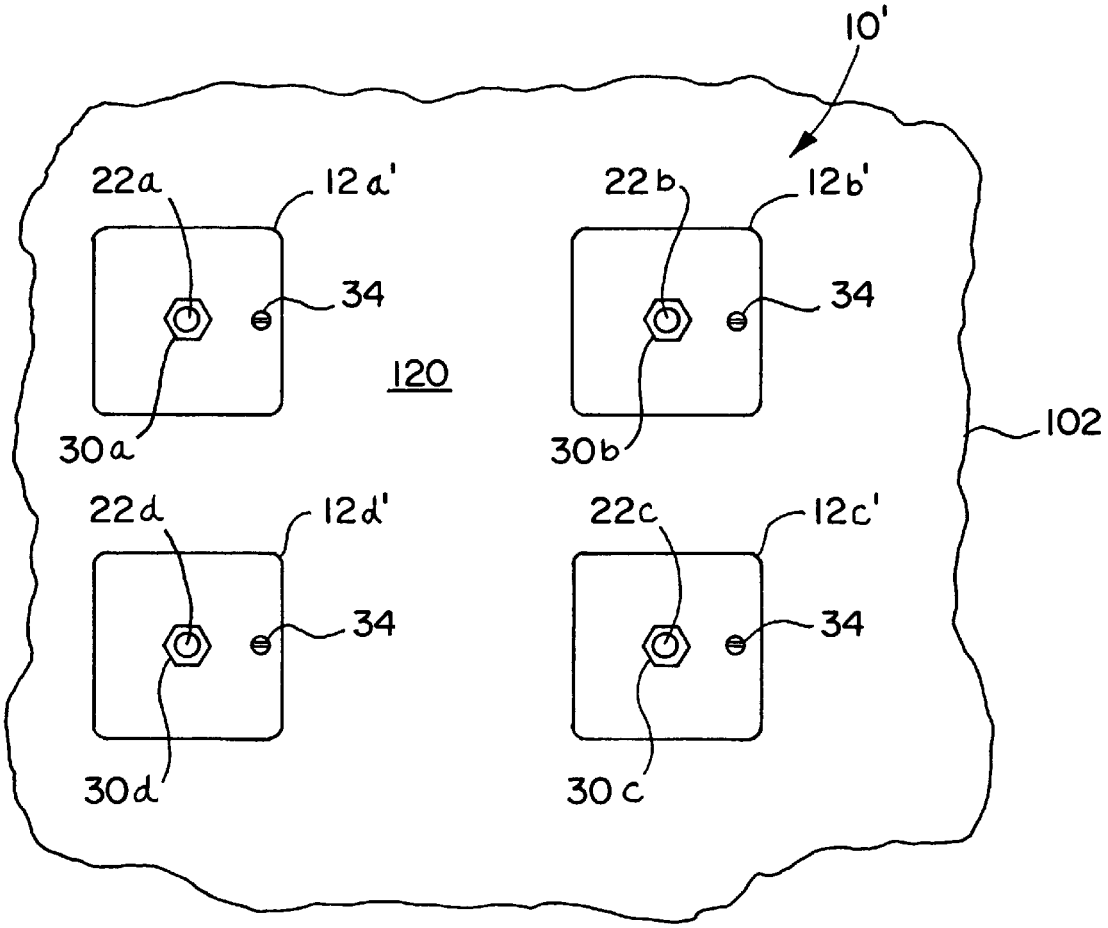
FIG. 11 is a bottom plan view of an alternative flush mount system.

An alternative embodiment of the flush mount system 10' is illustrated in FIG. 11 As shown, the single backing plate 12 is replaced by a plurality of separate backing plates 12*a–d'*. With the exception of size and the number of studs supported, the backing plates 12*a–d'* are generally identical to the backing plate 12 described above. Each of the backing plates 12*a–d'* includes a single threaded throughbore and is separately attached to the inner surface 120 of the mounting structure by screws 34, adhesive or other conventional fasteners. In this alternative embodiment, each of the separate backing plates 12*a–d'* receives and supports a single stud 22*a–d*, however, the number of studs supported by a single backing plate will vary from application to application. For example, another alternative embodiment (not shown) may include two separate backing plates, each supporting two studs.

Figure 9:
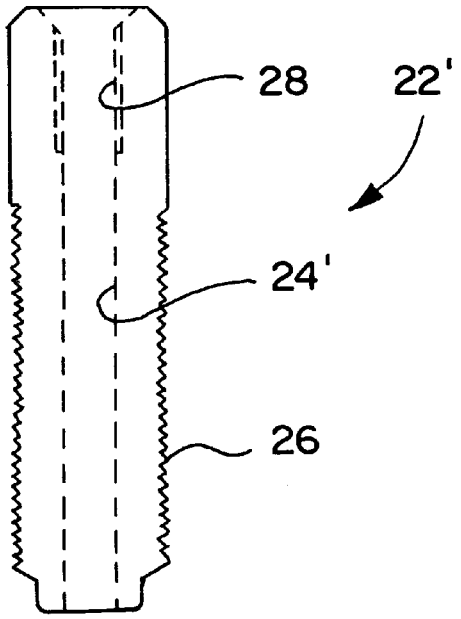
FIG. 9 is a side elevational view of a first alternative stud.
Figure 10:
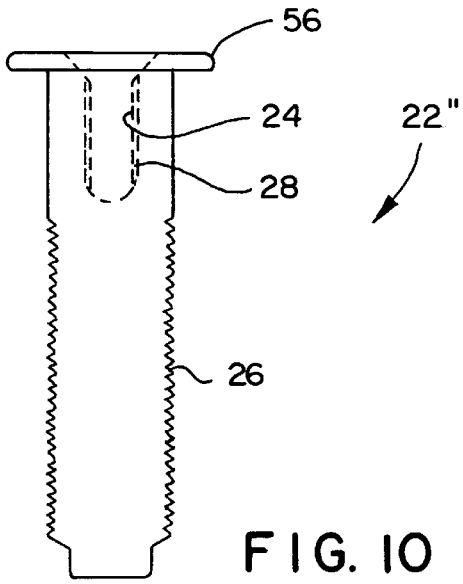
FIG. 10 is a side elevational view of a second alternative stud.

An alternative stud 22' is shown in FIG. 9. In this embodiment, the stud 22' defines a mounting bore 24' that extends entirely through the stud 22'. This prevents water from accumulating within the bore 24' where it may cause corrosion. This alternative stud 22' is particularly suited for use in locations where only the open hull is located below the backing plate 12. In such application, the small quantity of water that might leak through the stud 22' will simply flow into the hull where it is removed by the bilge pump. If desired, the cover screw 38 can be installed in the mounting bore 24' to address leakage when no accessories are installed. A second alternative stud 22" is shown in FIG. 10. The stud 22" of FIG. 10 is similar to the studs 22*a–d* of the above described embodiment, except that it includes a narrow head 56 at its upper end. The head 56 is recessed into the surface of the deck or hull, typically by a conventional counterbore. The head stabilizes the stud 22" within the deck 104 and provides increased structural support.

Figure 7:
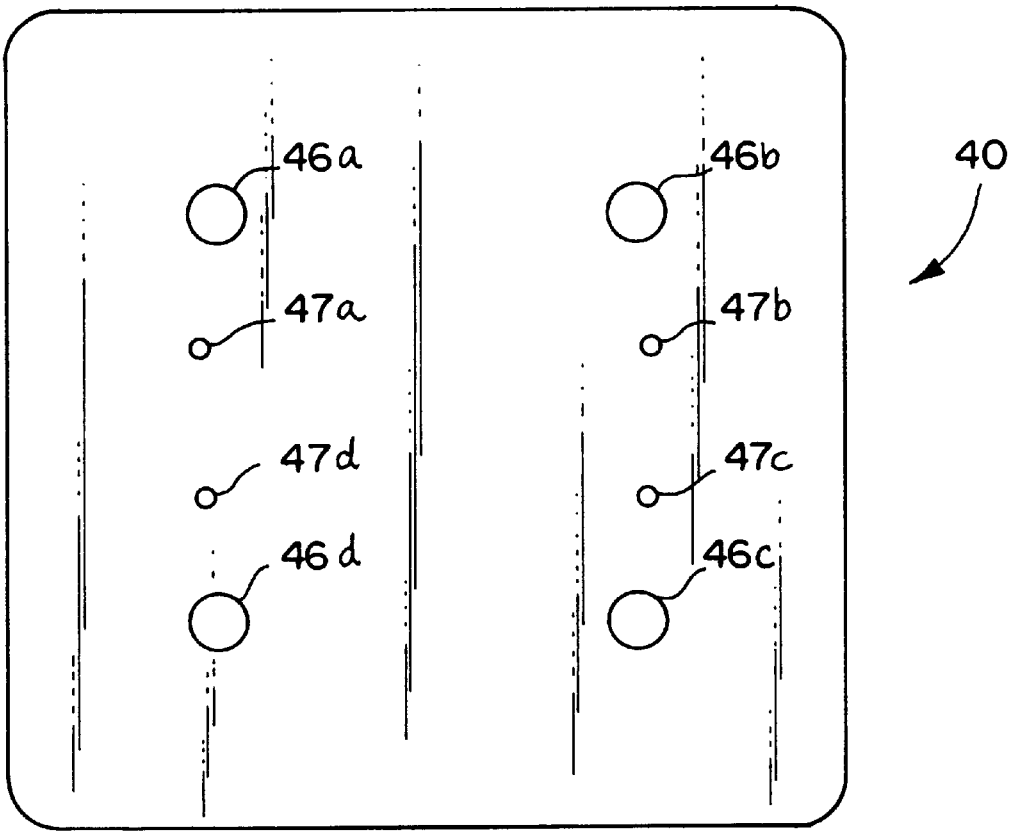
FIG. 7 is a top plan view of the standard mounting plate.
Figure 8:
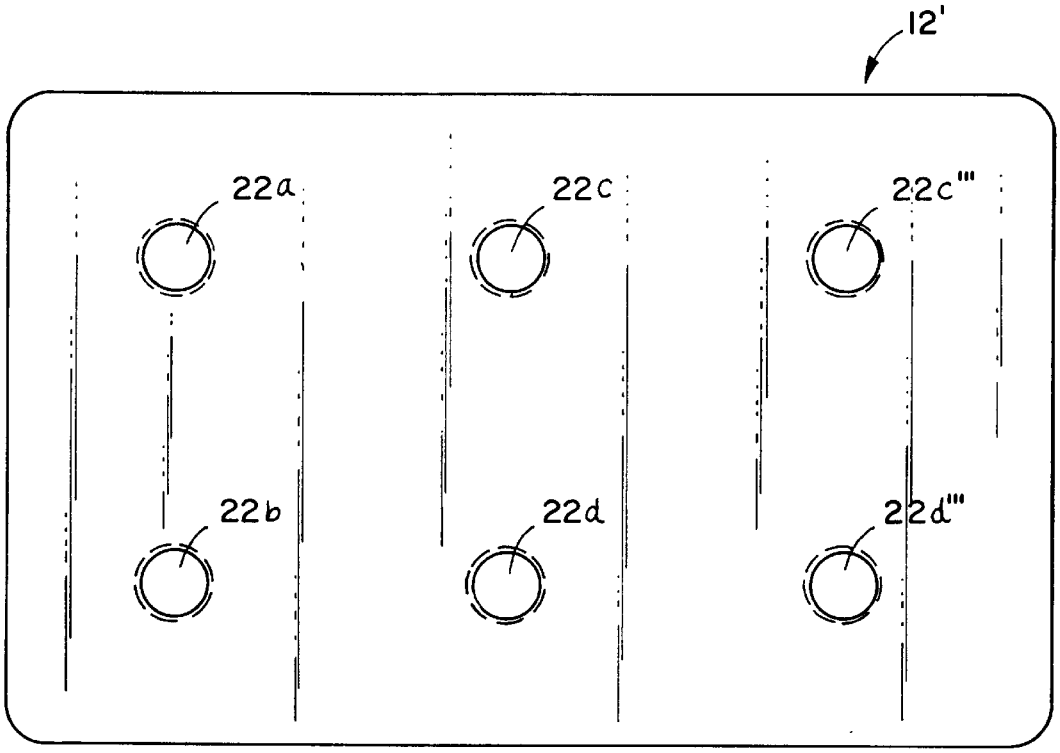
FIG. 8 is a top plan view of an alternative backing plate having two sets of mounting studs.

In applications where it is desirable to mount accessories with different mounting configurations to the same location, the flush mount system 10 can include a standard mounting plate 40 (See FIG. 7). In such applications, an accessory with a different mounting configuration can be mounted directly to the standard mounting plate 40, which can in turn be mounted to the mounting studs 22*a–d* of the flush mount system 10. The standard mounting plate 40 defines a plurality of throughbores 46*a–d* that correspond with the stud pattern on the backing plate 12. The standard mounting plate 40 is attached to the flush mount system 10 by conventional mounting bolts (not shown) that extend through the throughbores 46*a–d* into the stud mounting bores 24. The desired accessory is mounted to the standard mounting plate 40 using conventional fasteners (not shown) extending into mounting bores 47*a–d* arranged to correspond with the mounting configuration of the accessory. The undersurface of the standard mounting plate 40 can be countersunk or counterbore to receive the head of the fastener as needed. Alternatively, the standard mounting plate 40 can be contoured (not shown) to accommodate the head of the fastener. A gasket material (not shown) can be applied to the under surface of the standard mounting plate 40 to protect the deck 104 from scratching or marring. Alternatively, or in addition, multiple sets of studs can be installed in the backing plate to permit installation of accessories with different mounting footprints. For example, as shown in FIG. 8, the backing plate 12' can include a first set of studs 22*a–d* that define a square mounting footprint and a second set of studs 22*c–d'"* that cooperate with studs 22*a–b* to define a rectangular mounting footprint.

Manufacture, Installation and Use

The flush mount system 10 is manufactured using conventional techniques and apparatus. The backing plate 12 is preferably cut from three-eighths inch series 300 stainless steel, but, as described above, may be manufactured from other marine grade materials of the appropriate thickness to provide the necessary structural support. The stud throughbores 18*a–d* are drilled and tapped using conventional machinery. An alternative to threading the throughbores 18*a–d* is to secure a threaded nut (not shown) to the backing plate 40, such as by welding. Therefore, as used herein, the term "threaded bore" includes threads formed within the bore or within a nut, or other component, attached to the backing plate in alignment with the bore. The stud arrangement is selected to correspond with the mounting configuration of the desired accessory. The studs 22*a–d* are manufactured from segments of seven-eighths inch stainless steel rod. The studs 22*a–d* are externally threaded using conventional threading machinery. The mounting bores 24, internal threads 28 and countersink 58 are formed using conventional apparatus. The locknuts 30*d* are preferably conventional stainless steel nuts selected to mate with the external threads of the studs 22*a–d*. The cover screws 38 are preferably conventional stainless steel screws selected to thread within the mounting bores 24. The head 60 of the cover screw 38 is selected to correspond with the countersink 58. The materials, dimensions and manufacturing techniques described above are merely exemplary, and will vary from application to application as desired.

To install the flush mount system 10, the appropriate location on the vessel 100 is selected, for example, on the swim platform 102. The throughbores 154*a–d* are drilled through the deck 104 in the desired pattern. The pattern is typically selected to correspond with the bolt pattern on the mounting plate 152, but not necessarily if the standard mounting plate 40 is used. The backing plate 12 is then secured to the inner surface of the deck 104. Preferably, a layer of adhesive, such as 3M® 5200, is applied to the inner surface 14 and the backing plate 40 is attached to the deck 104 by a mounting screw 34 extending up through screw hole 50 into the deck 104. The mounting screw 34 holds the backing plate 40 in place while the adhesive dries. Additional mounting screws can be added as desired.

The studs 22*a–d* are threaded into the throughbores 118*a–d* either before or after the backing plate 40 is attached to the deck 104. Once the backing plate 40 is attached to the deck 104, the height of each stud 22*a–d* is adjusted so that the top of each stud 22*a–d* is flush with the outer surface 122 of the deck 104. The studs 22*a–d* are adjusted by threading them further into or out of the backing plate 12. Once the studs 22*a–d* are at the proper height, the locknuts 30*d* are threaded over the studs 22*a–d* and tightened against the backing plate 12. This locks the studs 22*a–d* at the desired height. A marine sealant 66 is applied around each stud 22*a–d* to seal any gap between the stud 22*a–d* and the deck 104. Cover screws 38 can be installed in the mounting bores 24, if desired.

Accessories are easily attached and removed from the flush mount system. As shown in FIG. 1, separate backing plates 12 can be mounted on opposite sides of the swim platform 102 to support different accessories, such as two davits 150*a–b* (shown in phantom lines), a stand off and a davit, a ladder and a stand off, etc. The davits 150*a–b*, or other accessories, are installed simply by aligning the throughbores in the davit mounting plates with the corresponding studs 22*a–d* and installing mounting bolts 156*a–d*. The davits 150*a–d* are removed by simply removing the mounting bolts 156*a–d*. If desired, cover screws 38 can be installed in the mounting bores 24 when the davits 150*a–b* are removed.

The above description is that of a preferred embodiment of the invention. Various alterations and changes can be made without departing from the spirit and broader aspects of the invention as defined in the appended claims which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. A mount system for securing accessories to mounting structure of a vessel comprising:

a backing plate adapted to be secured to an inner surface of the mounting structure of the vessel, said backing plate defining a stud bore with internal threads;

a stud having external threads and being threaded within said stud bore, said stud adapted to extend from said backing plate to an outer surface of the portion of the vessel, said stud having a height, said height being adjustable by interaction of said stud external threads with said stud bore internal threads, said stud defining a mounting bore, said mounting bore adapted to be accessible from the outer surface and having internal threads adapted to receive a mounting fastener for the accessory.

2. The system of claim 1 wherein said stud bore is further defined as a threaded throughbore, said height of said stud being adjustable by rotation of said stud within said stud bore.

3. The system of claim 2 further comprising a means for securing said stud within said stud bore to preclude further adjustment of said height of said stud.

4. The system of claim 3 wherein said securing means includes a locknut threaded over said stud in engagement with said backing plate.

5. The system of claim 4 wherein said stud defines a countersink surrounding said mounting bore; and further comprising a cover screw threaded into said mounting bore, said cover screw having a head corresponding with said countersink whereby said head is flush with said stud.

6. The system of claim 4 further comprising a plurality of said studs mounted within a plurality of said stud bores.

7. A combination comprising:

a vessel having a mounting structure with an inner surface and an outer surface, said mounting structure defining at least one throughbore; and a flush mount system mounted to said structure, said flush mount system including:

a backing plate disposed adjacent to said inner surface of said mounting structure, said backing plate defining at least one stud bore aligned with said mounting structure throughbore, said stud bore having internal threads;

a securing means for securing said backing plate to said mounting structure; and at least one stud having external threads and being threaded within said stud bore, said stud extending from said backing plate to said outer surface of said mounting structure, said stud having a height, said height being adjustable by interaction of said stud external threads with said stud bore internal threads, said stud defining a mounting bore, said mounting bore accessible from the outer surface and having internal threads adapted to receive a mounting fastener for mounting an accessory to said vessel.

8. The combination of claim 7 wherein said stud bore is further defined as a threaded throughbore, said height of said stud being adjustable by rotation of said stud within said stud bore.

9. The combination of claim 8 further comprising a means for securing said stud within said stud bore to preclude further adjustment of said height of said stud.

10. The combination of claim 9 wherein said securing means includes a locknut threaded over said stud in engagement with said backing plate.

11. The combination of claim 10 wherein said securing means includes a fastener extending into said mounting surface.

12. The combination of claim 10 wherein said securing means includes an adhesive.

13. The combination of claim 10 wherein said securing means includes a fastener and an adhesive.

14. The combination of claim 10 wherein said stud defines a countersink surrounding said mounting bore; and further comprising a cover screw threaded into said mounting bore, said cover screw having a head corresponding with said countersink whereby said head is flush with said stud.

15. The combination of claim 10 further comprising a plurality of said studs mounted within a plurality of said stud bores.

16. The combination of claim 10 further comprising a sealant disposed in said mounting structure throughbore between said stud and said mounting surface.

17. A method for installing a mount system in a mounting structure of a marine vessel:

providing a backing plate having at least one internally threaded stud bore and a stud threadedly received with the stud bore, the stud defining a mounting bore;

forming at least one throughbore in the mounting surface;

securing the backing plate to an inner surface of the mounting structure with the stud extending from the backing plate into the mounting surface throughbore; and adjusting a height of the stud such that the stud is flush with an outer surface of the mounting structure, the mounting bore being readily accessible from the outer surface for receiving a mounting bolt for installing an accessory on the vessel.

18. The method of claim 17 further comprising the step of securing the stud with respect to the backing plate after said adjusting step.

19. The method of claim 18 wherein said adjusting step includes rotating the stud with respect to the backing plate.

20. The method of claim 19 wherein said stud securing step includes tightening a locknut fitted over the stud against the backing plate.

21. The method of claim 20 further comprising the step of applying sealant around the stud within the mounting plate throughbore.

22. The method of claim 20 wherein said backing plate securing step includes applying an adhesive to the backing plate and installing a mounting screw through the backing plate into the mounting structure.

23. A combination comprising:

a vessel having a mounting structure with an inner surface and an outer surface, said mounting structure defining at least one throughbore; and a flush mount system mounted to said structure, said flush mount system including:

a backing plate mounted to said inner surface of said mounting structure; and a plurality of studs mounted to said backing plate, said studs extending from said backing plate to said outer surface of said mounting structure, each of said studs defining a mounting bore, said mounting bore accessible from the outer surface and having internal threads adapted to receive a mounting fastener for mounting an accessory to said vessel, said studs being arranged in a mounting configuration corresponding with a mounting pattern of the accessory.

24. A combination comprising:

a vessel having a mounting structure with an inner surface and an outer surface, said mounting structure defining at least one throughbore; and a flush mount system mounted to said structure, said flush mount system including:

a backing plate mounted to said inner surface of said mounting structure; and at least one stud mounted to said backing plate, said at least one stud extending from said backing plate to said outer surface of said mounting structure, said at least one stud defining a mounting bore, said mounting bore accessible from the outer surface and having internal threads adapted to receive a mounting fastener for mounting an accessory to said vessel.

25. The combination of claim 24 wherein said backing plate defines at least one internally threaded throughbore and said at least one stud includes external threads, said at least one stud being threadedly received within said at least one throughbore.

26. The combination of claim 25 further including a locknut threadedly received over said at least one stud and engaging said backing plate.

27. The combination of claim 26 wherein said mounting structure throughbore is counterbore and said at least one stud includes a head, said head being recessed within said counterbore.

* * * * *